US006543427B2

(12) United States Patent
Kawasaki

(10) Patent No.: US 6,543,427 B2
(45) Date of Patent: Apr. 8, 2003

(54) EXHAUST GAS RECIRCULATION SYSTEM PROVIDED IN AN ENGINE SYSTEM

(75) Inventor: Yukio Kawasaki, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 39 days.

(21) Appl. No.: 09/818,712

(22) Filed: Mar. 28, 2001

(65) Prior Publication Data

US 2001/0047798 A1 Dec. 6, 2001

(30) Foreign Application Priority Data

Mar. 30, 2000 (JP) ..... 2000-094620

(51) Int. Cl.[7] ..... F02B 47/08
(52) U.S. Cl. ..... 123/568.12; 60/324
(58) Field of Search ..... 123/568.12, 568.17, 123/568.18, 568.2; 60/291, 292, 287, 288, 298, 324, 605.2

(56) References Cited

U.S. PATENT DOCUMENTS

| | | | | |
|---|---|---|---|---|
| 3,577,727 A | * | 5/1971 | Warren et al. | 123/323 |
| 3,645,098 A | * | 2/1972 | Templin et al. | 123/568.11 |
| 3,776,207 A | * | 12/1973 | Simko | 123/568.12 |
| 6,155,042 A | * | 12/2000 | Perset et al. | 123/568.12 |
| 6,422,218 B1 | * | 7/2002 | Neuschwander | 123/568.12 |

FOREIGN PATENT DOCUMENTS

JP 11-117815 4/1999

OTHER PUBLICATIONS

"Motor Fan additional volume, All about New Model Pajero", Sanei–shobo Publishing Co., Ltd., pp. 23–24, Oct. 23, 1999.

* cited by examiner

*Primary Examiner*—Henry C. Yuen
*Assistant Examiner*—Mahmoud Gimie
(74) *Attorney, Agent, or Firm*—Burns, Doane, Swecker & Mathis, LLP

(57) ABSTRACT

An exhaust gas recirculation (EGR) system in an engine system includes an intake passage, an exhaust passage, an EGR passage, a connecting passage and an exhaust gas regulating valve. The exhaust passage is provided with a catalyst and a muffler. The EGR passage is provided with a heat exchanger and an EGR valve. The connecting passage fluidly connects the exhaust passage and the EGR passage. The exhaust gas regulating valve is mounted at a merging portion defined between the exhaust passage and the connecting passage. Based on the opening degree of the exhaust gas regulating valve, the exhaust gas flow is adjustably regulated into recirculating flow into the EGR passage or flow through the exhaust passage. Based on the opening degree of the EGR valve, the recirculated exhaust gas in the EGR passage is adjustably regulated into recirculating flow into the intake passage or flow into the connecting passage after passing through the heat exchanger.

20 Claims, 5 Drawing Sheets

EXHAUST GAS RECIRCULATION SYSTEM PROVIDED IN AN ENGINE SYSTEM

This application is based on and claims priority under 35 U.S.C. §119 with respect to Japanese Application No. 2000-094620 filed on Mar. 30, 2000, the entire content of which is incorporated herein by reference.

FIELD OF THE INVENTION

This invention generally relates to an exhaust gas recirculation (EGR) system in an automobile engine and the like. More particularly, the present invention pertains to an EGR system for purifying harmful products contained In the exhaust gas of an engine and efficiently absorbing heat energy contained in the exhaust gas to assist engine warm-up using the heat energy.

BACKGROUND OF THE INVENTION

Over the years, much development work has been performed with respect to engines functioning as a power source for an automobile. Environmental concerns have contributed to the recognition that purifying the engine exhaust gas and improving the efficiency of the engine performance are important.

A publication entitled "Motor Fan additional volume, All about New Model Pajero" (Pages 23 and 24, Oct. 23, 1999, Sanei-shobo Publishing Co., Ltd.) discloses a known system to purify harmful products contained in the exhaust gas. With this system, exhaust gas emitted from an engine unit is recirculated back to the intake side via an EGR passage. Additionally, the recirculated exhaust gas quantity is regulated in accordance with the degree of opening of an EGR valve, so that the EGR system is able to purify the harmful products contained in the exhaust gas.

The EGR passage is provided with a water-cooled heat exchanger, oftentimes called an EGR cooler. The EGR cooler is able to refrigerate or cool the exhaust gas recirculated thereto from 300 degrees centigrade down to 180 degrees centigrade. By lowering the temperature of the exhaust gas recirculated to the intake side, the recirculated exhaust gas quantity can be increased. Therefore, this known EGR system possesses improved charging efficiency to fill the engine unit with fresh air, thereby reducing the production of NOx (nitrogen oxide) and minimizing emission of PM (particulate matters) including black smoke.

As mentioned above, the improvement in the efficiency of the engine performance produces an environmentally-friendly effect, including improved fuel economy.

However, improvements in the efficiency of the engine performance may cause drawbacks. For example, the engine may require a long time to warm-up, and the heating performance of the engine may degrade. These drawbacks may affect the driving comfort and stability of the automobile.

A need thus exists for a system that is able to improve purification of the exhaust gas, while at the same time improving engine warm-up and the efficiency of the engine performance.

It would be desirable to provide a system that assists the engine warm-up using heat energy contained in the exhaust gas.

It would also be desirable to purify harmful products contained in the exhaust gas.

SUMMARY OF THE INVENTION

According to the present invention, an exhaust gas recirculation (EGR) system in an engine system includes an intake passage, an exhaust passage, and an EGR passage diverging at a first diverging portion in the exhaust passage. The exhaust gas flowing through the exhaust passage is recirculated via the EGR passage into the intake passage. The EGR passage is further provided with a heat exchanger and an EGR valve. A second diverging portion is defined in the EGR passage downstream from the heat exchanger and a merging portion is defined in the exhaust passage downstream from the first diverging portion. A connecting passage fluidly connects the second diverging portion and the merging portion. An exhaust gas regulating valve is mounted at the first diverging portion or at the merging portion in the exhaust passage, wherein the exhaust gas quantity recirculated into the connecting passage is adjustably regulated by the exhaust gas regulating valve.

When the exhaust gas regulating valve mounted at the first diverging portion or at the merging portion is set to a fully closed position (fully cutting off airflow from the exhaust passage into a muffler via a catalyst), the exhaust gas is recirculated back to the exhaust passage via the first diverging portion, the heat exchanger of the EGR passage, the connecting passage, and the merging portion. When the exhaust gas regulating valve is set to a fully opened position (fully fluidly connecting the airflow from the exhaust passage to the muffler), the fluidly connected airflow from the exhaust passage to the connecting passage is interrupted, therefore the aforementioned EGR through the connecting passage does not occur. However, based on the opening degree of the EGR valve, the exhaust gas can be recirculated back into the intake passage via the first diverging portion and the heat exchanger of the EGR passage. Additionally, the exhaust gas regulating valve can be set to an intermediate position between the opened and closed positions as well.

The high temperature exhaust gas flowing through the exhaust passage is fluidly diverged or diverted into the EGR passage, whereby the exhaust gas heat energy warms up the engine coolant by heat exchange at the heat exchanger. This mechanism can effectively raise the coolant temperature and improve the engine warm-up.

In more detail, the recirculated exhaust gas quantity is regulated in correspondence with the temperature of the engine coolant. When the engine coolant temperature is less than a predetermined value, the exhaust gas regulating valve is set to the fully closed position, wherein the exhaust gas quantity flowing into the connecting passage is at a maximum. When the engine coolant temperature is equal to or larger than the predetermined value, the exhaust gas regulating valve is set to the fully opened position, wherein the exhaust gas quantity flowing into the connecting passage is at a minimum.

When the coolant temperature is less than the predetermined value and sufficient engine warm-up is not achieved, the high temperature exhaust gas flowing through the exhaust passage is fluidly diverged or diverted into the EGR passage, whereby the exhaust gas heat energy can warm up the engine coolant by way of heat exchange at the heat exchanger. The coolant temperature can thus be effectively raised to improve the engine warm-up.

Additionally, the recirculated exhaust gas quantity is regulated in correspondence to the engine speed and the engine load. When the engine speed is low and the engine load is small, the exhaust gas regulating valve is set to the fully closed position, wherein the exhaust gas quantity flowing into the connecting passage is at a maximum. Corresponding to an increase of the engine speed and the engine load, the exhaust gas regulating valve is orderly set to the intermediate position and at the fully opening position, wherein the exhaust gas quantity flowing into the connecting passage is decreased.

Even when sufficient engine warm-up is not achieved, the EGR system of the present invention can decrease the exhaust gas quantity recirculated into the connecting passage and increase the exhaust gas quantity directed through the exhaust passage to the muffler based on the increase of the engine speed and the engine load. The EGR system of the present invention thus does not degrade the exhausting performance.

Furthermore, the recirculated exhaust gas quantity is regulated in correspondence to the catalyst temperature. When the catalyst temperature is low, the exhaust gas regulating valve is set to the fully opened position, wherein the exhaust gas flows into the connecting passage at a minimum. With an increase in the catalyst temperature, the exhaust gas regulating valve is orderly set to the intermediate position and the fully closed position, wherein the exhaust gas quantity flowing into the connecting passage is increased.

Even when sufficient engine warm-up is not achieved, the EGR system of the present invention can decrease the exhaust gas quantity recirculated into the connecting passage corresponding to the low catalyst temperature. Therefore, this mechanism can effectively increase the exhaust gas quantity directed from the exhaust passage to the catalyst and the muffler, wherein the catalyst warm-up is efficiently improved.

Additionally, another exhaust gas regulating valve can be mounted in the EGR passage between the heat exchanger and the EGR valve. The other exhaust gas regulating valve is closed when the exhaust gas regulating valve is positioned at the fully closing position or at the intermediate position. Therefore, high temperature exhaust gas does not flow into the EGR valve. Thus, the other exhaust gas regulating valve effectively prevents the high temperature exhaust gas from flowing to the EGR valve, whereby thermal damage to the EGR valve is minimized.

Thus, considering the exhaust gas emitted through the engine unit and recirculated into the intake side via the engine coolant corresponding to the engine speed, engine load, catalyst temperature, the EGR system can improve the engine warm-up and at the same time purify the exhaust gas to retain the exhausting performance.

In accordance with another aspect of the invention, an engine exhaust gas recirculation system includes an exhaust passage extending from an exhaust manifold of an engine, a muffler disposed along the exhaust passage, an EGR passage communicating with the exhaust passage at a point upstream of the muffler to direct the exhaust gas from the exhaust passage towards a heat exchanger mounted in the EGR passage, a connecting passage fluidly connected to the EGR passage at a point downstream from the heat exchanger and fluidly connected to the exhaust passage at a point downstream from where the EGR passage communicates with the exhaust passage, and an exhaust gas regulating valve mounted between the muffler and the point at which the EGR passage communicates with the exhaust passage.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
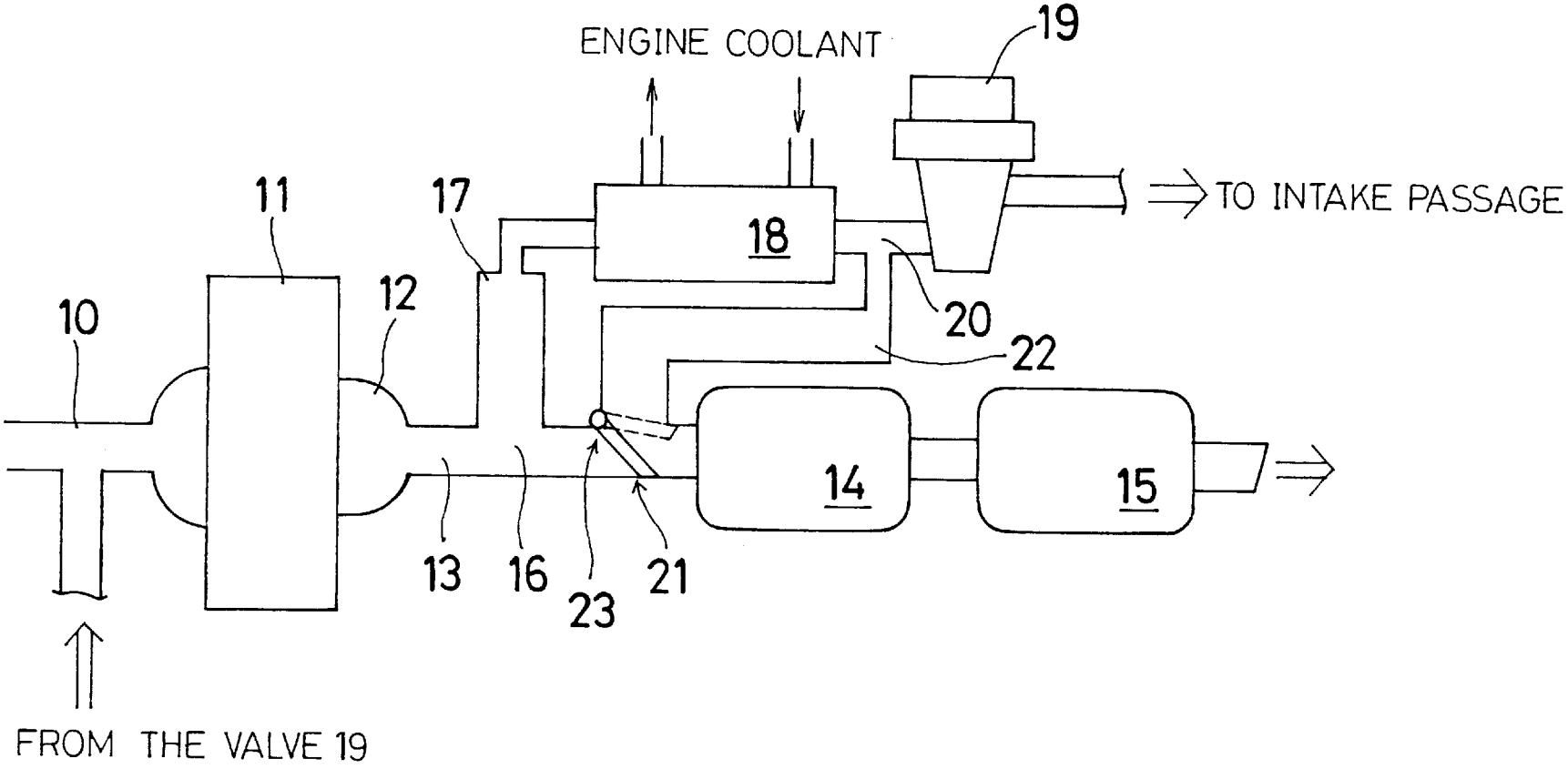
FIG. 1 is a schematic illustration of an engine system having an exhaust gas recirculation (EGR) system according to an embodiment of the present invention.

Referring initially to FIG. 1, the exhaust gas recirculation (EGR) system according to one embodiment of the present invention includes an engine unit 11 provided with an exhaust manifold 12, an exhaust passage 13, an intake passage 10 and an intake manifold. The exhaust passage 13 is provided with an exhaust catalyst 14 and a muffler 15. The exhaust catalyst 14 is adapted to effectively purify CO (carbon monoxide) and HC (hydrocarbon) contained in the exhaust gas.

A first diverging portion 16 is defined in the exhaust passage 13 upstream from the exhaust catalyst 14. An EGR passage 17 is in fluid communication with the first diverging portion 16 and the intake manifold. The EGR passage 17 is provided with a heat exchanger 18 and an EGR valve 19. Engine coolant is adapted to be introduced into the heat exchanger 18. Accordingly, when the exhaust gas emitted from the exhaust manifold 12 is introduced via the EGR passage 17 into the heat exchanger 18, the relatively high temperature exhaust gas is refrigerated or cooled by the relatively low temperature engine coolant of the heat exchanger 18, to raise the temperature of the engine coolant.

A second diverging portion 20 is defined in the EGR passage 17 downstream of the heat exchanger 18 at a position between the heat exchanger 18 and the EGR valve 19. A first merging portion 21 is defined in the exhaust passage 13 downstream from the first diverging portion 16 and upstream from the catalyst 14. A connecting passage 22 fluidly connects the second diverging portion 20 and the first merging portion 21. An exhaust gas regulating valve 23 is mounted at the first merging portion 21. Corresponding to the degree of opening of an exhaust gas regulating valve 23, the quantity of exhaust gas emitted from the exhaust manifold 12 is adjustably regulated in the following two principal gas flows.

The exhaust gas directly flows through the exhaust passage 13 into the muffler 15. Meanwhile, the exhaust gas is also recirculated back to the exhaust passage 13 via the heat exchanger 18 and the connecting passage 22, so as to be refrigerated or cooled by the engine coolant of the heat exchanger 18. The engine system according to this first embodiment of the present invention also includes a central processing unit (CPU). Various control signals to control the exhaust gas regulating valve 23 are inputted into the CPU, including control signals indicating the engine speed (an engine rotation number), the engine load, the injection quantity, a catalyst temperature, an oxygen density in the exhaust gas and the like.

The EGR system described above operates in the following manner. The CPU operates to adjustably control the opening and closing of the exhaust gas regulating valve 23. In accordance with the flow diagram shown in FIG. 2, an ignition switch is first set to be the ON position at an initial start step S1. At a second step S2, the exhaust gas regulating valve 23 is set to an initial position (represented by the double-dashed line in FIG. 1), so that exhaust gas does not flow from the connecting passage 22 into the exhaust passage 13. At a third step S3, the CPU detects the temperature of the engine coolant by a coolant temperature sensor which is operatively connected to the CPU. The coolant temperature sensor outputs a signal based on the water temperature information.

In response to the output signal from the coolant temperature sensor, when the temperature is equal to or greater than a predetermined value TO, the CPU judges that the engine unit is sufficiently warmed up and so the EGR system proceeds to a fourth step S4. In the fourth step S4, the exhaust gas regulating valve 23 is set to a fully open position B (represented by the double-dashed line in FIG. 1). The open position B of the valve 23 is positioned to fully fluidly connect the exhaust passage 13 and the muffler 15 to effect gas flow from the exhaust passage 13 into the muffler 15. After the exhaust gas regulating valve 23 is set to the open position B, the EGR system returns to the third step S3.

On the other hand, if it is determined in response to the output signal from the coolant temperature sensor that the coolant temperature is less than the predetermined value TO, the CPU judges that the engine unit is not sufficiently warmed up and so that the EGR system proceeds to a fifth step S5. In the fifth step S5, the exhaust gas regulating valve 23 is set to the following three positions, a fully closed position A, the fully open position B or an intermediate position C. The exhaust gas regulating valve 23 is set to any one of these three positions based on the engine speed and the engine load as shown in the control map in FIG. 3. The exhaust gas regulating valve 23 set to the fully open position B at the fourth step S4 is shown with the double dashed line in FIG. 1. The exhaust gas regulating valve 23 set to the fully closed position A at a sixth step S6 is shown with a solid line in FIG. 1, fully cutting off the airflow from the exhaust passage 13 into the muffler 15. The exhaust gas regulating valve 23 is set to the intermediate position C between the fully closed position A and the fully open position B at a seventh step S7. The most appropriate position of the intermediate position C is adjustably varied in response to the various output signals from the CPU. After execution of steps S4, S6 and S7, the EGR system returns to the third step S3.

Explaining in more detail the exhaust gas flow at each step S4, S6 and S7, at the fourth step S4, the exhaust gas regulating valve 23 is set to the fully open position B. In principle, the entire high temperature exhaust gas emitted from the engine unit 11 is eventually exhausted to the atmosphere through the direct flow in the exhaust passage 13, the exhaust catalyst 14 and the muffler 15. However, in accordance with the degree of opening of the EGR valve 19, the exhaust gas partially flows into the EGR passage 17 via the first diverging portion 16 so that the exhaust gas is refrigerated or cooled in the heat exchanger 18 and recirculated into the intake manifold.

At the sixth step S6, a downstream portion of the exhaust passage 13 is closed by virtue of the exhaust gas regulating valve 23, which is mounted at the first merging portion 21, being set to the fully closed position A. The entire high temperature exhaust gas emitted from the engine unit 11 thus flows through the exhaust passage 13 into the EGR passage 17 via the first diverging portion 16. The high temperature exhaust gas is able to effectively warm up the low temperature engine coolant of the heat exchanger 18 when sufficient engine warm-up is not still achieved. In accordance with the degree of opening of the EGR valve 19, the high temperature exhaust gas is adjustably regulated in two different flows, recirculated into the intake manifold or eventually exhausted to the atmosphere via the connecting passage 22, the exhaust catalyst 14 and the muffler 15.

At the seventh step S7, the exhaust gas regulating valve 23 is set to the intermediate position C. The entire high temperature exhaust gas emitted from the engine unit 11 is first diverged in the following two different flows, flow into the EGR passage 17 and the heat exchanger 18 via the exhaust passage 13 and the first diverging portion 16, or eventually exhausted to the atmosphere through direct flow in the exhaust passage 13, the exhaust catalyst 14 and the muffler 15.

The aforementioned flows are determined in accordance with the degree of opening of the EGR valve 19. Based on the degree of opening of the EGR valve 19, the exhaust gas flow introduced into the EGR passage 17 is adjustably diverged or separated in the following two different flows, recirculated into the intake manifold or eventually exhausted to the atmosphere via the connecting passage 22, the exhaust catalyst 14 and the muffler 15, which is the same way as demonstrated at the sixth step S6.

The heat exchanger 18 is actuated for the two following purposes. The heat exchanger 18 effectively serves to assist the engine warm-up by heating the engine coolant thereof when the engine warm-up is not sufficiently achieved. In addition, independent of the engine warm-up condition, the heat exchanger 18 effectively serves to refrigerate or cool the exhaust gas recirculated into the intake manifold based on the degree of opening of the EGR valve 19.

In accordance with the present invention, when the coolant temperature is less than the predetermined value TO and sufficient engine warm-up is not achieved, the high temperature exhaust gas flowing through the exhaust passage 13 is fluidly diverged or diverted into the EGR passage 17, whereby the exhaust gas heat energy warms up the engine coolant of the heat exchanger 18. This mechanism effectively can raise the coolant temperature and improve the engine warm-up.

The heat exchanging by the heat exchanger 18 also has the following advantages. The cooled exhaust gas effectively minimizes thermal damages on the EGR valve 19 and the intake components, most of which are now made of resin material. Therefore, the charging efficiency associated with filling the engine combustion chamber (not shown) provided with the engine unit 11 with gas and fresh air is effectively improved. It is to be understood that the EGR valve 19 is well known and so a detailed explanation is not included here.

Figure 2:
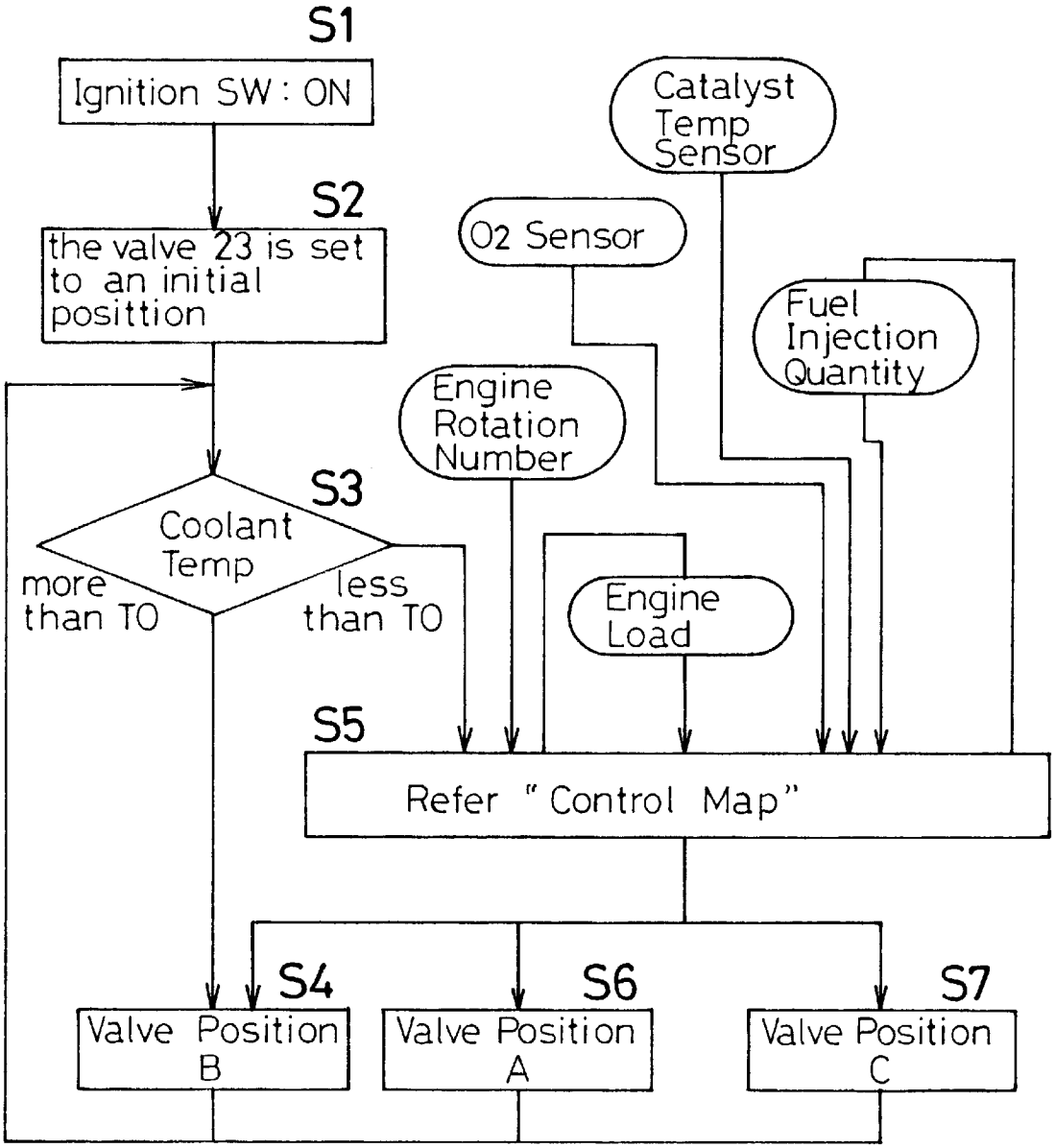
FIG. 2 is a flow diagram of the EGR system illustrated in FIG. 1.
Figure 3:
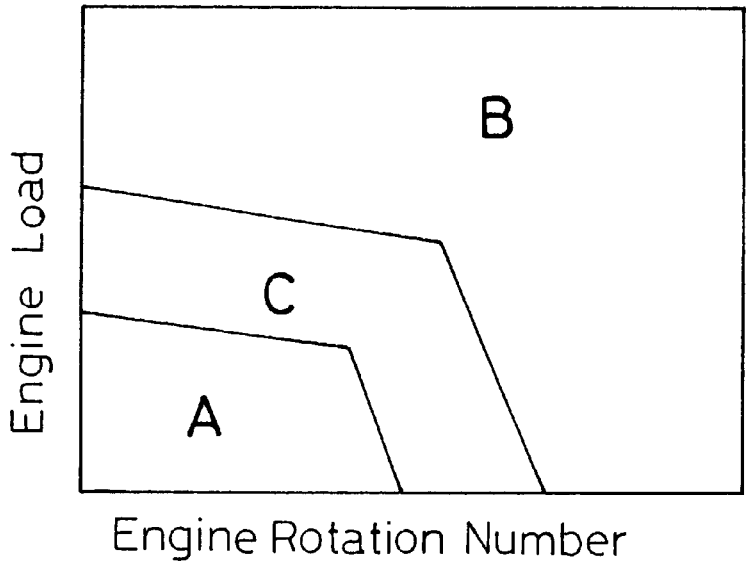
FIG. 3 is a valve opening control map for the EGR valve used in the system illustrated in FIG. 1.

Regarding the fifth step S5 in FIG. 2 and the control map shown in FIG. 3, the position of the exhaust gas regulating valve 23 is determined at either position A, B or C based on the engine speed and the engine load as shown in FIG. 3. When the engine speed is low and the engine load is small, the exhaust gas regulating valve 23 is set to the fully closed position A and the exhaust gas flowing into the EGR passage 17 (in other words, into the connecting passage 22) is at a maximum. The high temperature of the exhaust gas flowing into the EGR passage 17 is transmitted or transferred to the engine coolant, to thereby effectively improve the engine warm-up through use of the transferred temperature. With an increase in the engine speed or the engine load, the exhaust gas regulating valve 23 is in sequence set to the intermediate position C and the fully open position B. In accordance with the orderly adjusted position of the exhaust gas regulating valve 23, the exhaust gas quantity flowing into the EGR passage 17 is decreased. In other words, the exhaust gas quantity flowing directly through the exhaust passage 13 into the muffler 15 is increased. Therefore, this mechanism does not affect the exhausting performance of the engine system. Moreover, this mechanism improves the engine warm-up and driving performance, driving comfort and stability of the automobile provided with the engine system.

Even when sufficient engine warm-up is not achieved, the EGR system of the present invention can decrease the exhaust gas quantity recirculated into the connecting passage 22 and increase the exhaust gas quantity directed through the exhaust passage 13 to the muffler 15 based on an increase of the engine speed and the engine load, wherein the EGR system of the present invention does not degrade the exhausting performance.

Figure 4:
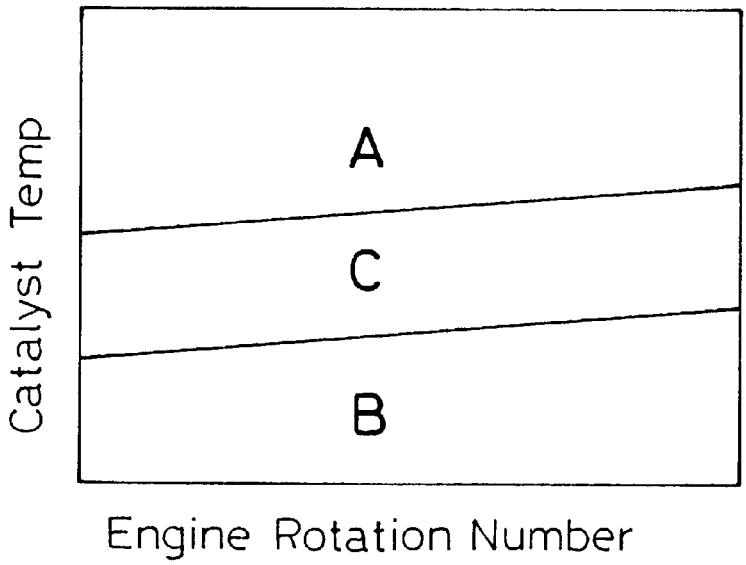
FIG. 4 is another valve opening control map for the EGR valve illustrated in FIG. 1.

Referring once again to the fifth step S5 in FIG. 2, but in conjunction with a different control map as shown in FIG. 4, the position of the exhaust gas regulating valve 23 is determined at either position A, B, or C relative to the engine speed and a catalyst temperature as shown in FIG. 4. A moderate catalyst warm-up is necessary to improve the efficiency of the catalyst performance. When the catalyst temperature is low, the exhaust gas regulating valve 23 is set to the fully open position B and the exhaust gas quantity flowing into the EGR passage 17 (in other words, into the connecting passage 22) is at a minimum. The high temperature of the exhaust gas directed to the catalyst 14 is transmitted into the catalyst 14, wherein the catalyst warm-up is effectively improved. Based on an increase of the catalyst temperature, the exhaust gas regulating valve 23 is set in sequence to the intermediate position C and the fully closed position A. In accordance with the orderly adjusted position of the exhaust gas regulating valve 23, the exhaust gas quantity flowing into the EGR passage 17 is increased. In other words, the exhaust gas quantity flowing into the heat exchanger 18 is increased. This mechanism improves the engine warm-up in accordance with an increase in the amount of the heated coolant. The catalyst temperature can be measured directly by a catalyst temperature sensor (not shown) or can be determined from the engine water temperature.

Even when sufficient engine warm-up is not achieved, the EGR system of the present invention is able to decrease the exhaust gas quantity recirculated into the connecting passage 22 corresponding to the low catalyst temperature. Therefore, this mechanism effectively increases the exhaust gas quantity directed from the exhaust passage 13 to the catalyst 14 and the muffler 15, whereby the catalyst warm-up is efficiently improved. Therefore, the EGR system of the present invention does not degrade the exhausting performance.

Figure 5:
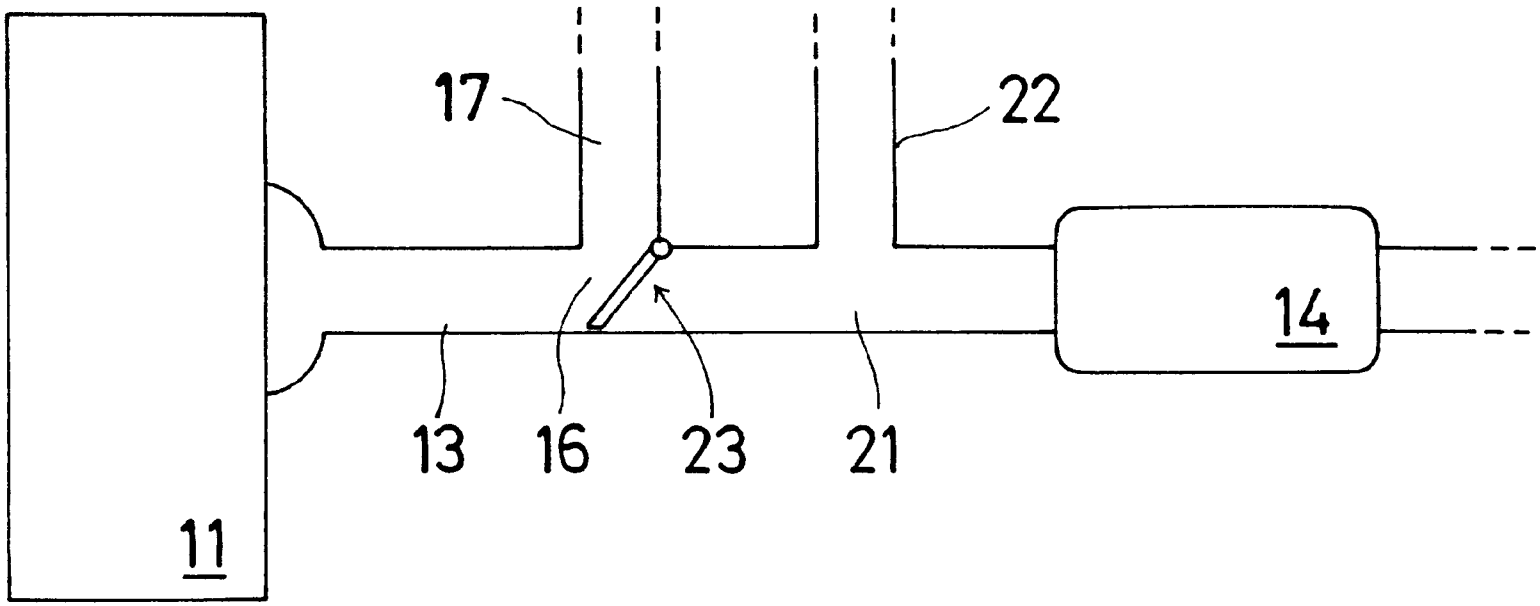
FIG. 5 is a schematic illustration of an engine system having an EGR system according to a second embodiment of the present invention.

FIG. 5 shows a second embodiment according to the present invention. In this second embodiment, the exhaust gas regulating valve 23 is not mounted at the first merging portion 21, but rather is mounted at the first diverging portion 16.

Figure 6:
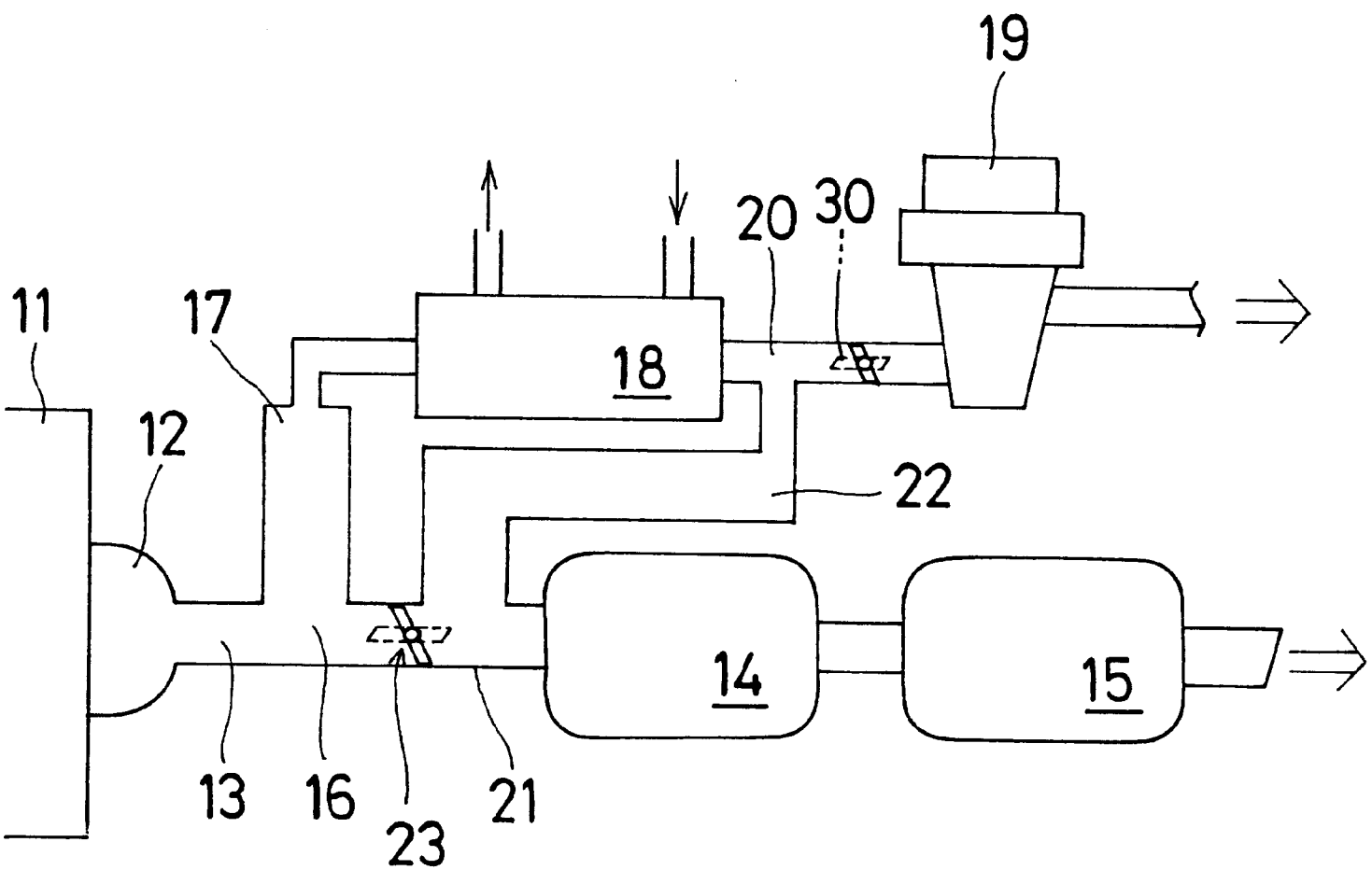
FIG. 6 is a schematic illustration of an engine system having an EGR system according to a third embodiment of the present invention.

FIG. 6 shows a third embodiment according to the present invention. In this embodiment, another exhaust gas regulating valve 30 is mounted in the EGR passage 17 between the heat exchanger 18 and the EGR valve 19. The other exhaust gas regulating valve 30 is actuated when the exhaust gas regulating valve 23 is set to the fully closed position A or to the intermediate position C. The other exhaust gas regulating valve 30 effectively works to prevent the high-temperature exhaust gas from reaching the EGR valve 19. Therefore, the other exhaust gas regulating valve 30 effectively minimizes thermal damage to the EGR valve 19.

The principles, preferred embodiments and modes of operation of the present invention have been described in the foregoing specification. However, the invention which is intended to be protected is not to be construed as limited to the particular embodiments disclosed. Further, the embodiments described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An exhaust gas recirculation system in an engine system, comprising:

an intake passage and an exhaust passage of an engine unit;

an EGR passage recirculating the exhaust gas from the exhaust passage into the intake passage;

a heat exchanger mounted in the EGR passage for heat-exchanging an engine coolant;

an EGR valve mounted in the EGR passage downstream from the heat exchanger;

a first diverging portion in the exhaust passage for directing exhaust gas in the exhaust passage to the EGR passage;

a second diverging portion in the EGR passage downstream from the heat exchanger;

a merging portion defined in the exhaust passage downstream from the first diverging portion;

a connecting passage fluidly connecting the second diverging portion and the merging portion; and an exhaust gas regulating valve mounted at one of the first diverging portion and the merging portion in the exhaust passage to adjustably regulate a quantity of exhaust gas in the EGR passage that is recirculated into the exhaust passage by way of the connecting passage and a quantity of gas in the exhaust passage directly passing to the merging portion.

2. The exhaust gas recirculation system in the engine system according to claim 1, wherein the exhaust gas regulating valve is a first exhaust gas regulating valve, and including an additional exhaust gas regulating valve mounted between the heat exchanger and the EGR valve in the EGR passage.

3. The exhaust gas recirculation system in the engine system according to claim 2, wherein an opening degree of the first exhaust gas regulating valve is varied between a fully closed position, a fully opened position and an intermediate position between the fully closed position and the fully opened position in response to an increase of a temperature of the engine coolant to decrease the exhaust gas quantity flowing into the connecting passage.

4. The exhaust gas recirculation system in the engine system according to claim 1, wherein an opening degree of the exhaust gas regulating valve is varied between a fully closed position, a fully opened position and an intermediate position between the fully closed position and the fully opened position in response to an increase of a temperature of the engine coolant to decrease the exhaust gas quantity flowing into the connecting passage.

5. The exhaust gas recirculation system in the engine system according to claim 1, wherein an opening degree of the exhaust gas regulating valve is varied between a fully closed position, a fully opened position and an intermediate position between the fully closed position and the fully opened position in response to rotation of an engine of the engine system and an engine load to decrease the exhaust gas quantity flowing into the connecting passage.

6. The exhaust gas recirculation system in the engine system according to claim 2, wherein an opening degree of the first exhaust gas regulating valve is varied between a fully closed position, a fully opened position and an intermediate position between the fully closed position and the fully opened position in response to an increase of an engine speed and an engine load to decrease the exhaust gas quantity flowing into the connecting passage.

7. The exhaust gas recirculation system in the engine system according to claim 1, wherein an opening degree of the exhaust gas regulating valve is varied between a fully closed position, a fully opened position and an intermediate position between the fully closed position and the fully opened position in response to an increase of a catalyst temperature to increase the exhaust gas quantity flowing into the connecting passage.

8. The exhaust gas recirculation system in the engine system according to claim 2, wherein an opening degree of the first exhaust gas regulating valve is varied between a fully closed position, a fully opened position and an intermediate position between the fully closed position and the fully opened position in response to an increase of a catalyst temperature to increase the exhaust gas quantity flowing into the connecting passage.

9. The exhaust gas recirculation system in the engine system according to claim 1, wherein an opening degree of the exhaust gas regulating valve is set to the fully closed position when the temperature of the engine coolant is less than a predetermined value so that the exhaust gas quantity flowing into the connecting passage is at a maximum, and the opening degree of the exhaust gas regulating valve being set to the fully opened position when the temperature of the engine coolant is equal to or greater than the predetermined value so that the exhaust gas quantity flowing into the connecting passage is at a minimum.

10. The exhaust gas recirculation system in the engine system according to claim 5, wherein the opening degree of the exhaust gas regulating valve is set to the fully closed position when the engine speed is lower than a predetermined value and the engine load is smaller than a predetermined value so that the exhaust gas quantity flowing into the connecting passage is at a maximum, and the exhaust gas regulating valve being set to the fully opened position when the engine speed is equal to or greater than the predetermined value and the engine load is equal to or greater than the predetermined value so that the exhaust gas quantity flowing into the connecting passage is at a minimum.

11. The exhaust gas recirculation system in the engine system according to claim 6, wherein the opening degree of the first exhaust gas regulating valve is set to the fully closed position when the engine speed is lower than a predetermined value and the engine load is smaller than a predetermined value so that the exhaust gas quantity flowing into the connecting passage is at a maximum, and the first exhaust gas regulating valve being set to the fully opened position when the engine speed is equal to or greater than the predetermined value and the engine load is equal to or greater than the predetermined value so that the exhaust gas quantity flowing into the connecting passage is at a minimum.

12. The exhaust gas recirculation system in the engine system according to claim 7, wherein the opening degree of the exhaust gas regulating valve is set to the fully opened position when the catalyst temperature is lower than a predetermined value so that the exhaust gas quantity flowing into the connecting passage is at a minimum, and the opening degree of the exhaust gas regulating valve being set to the fully closed position when the catalyst temperature is equal to or more than the predetermined value so that the exhaust gas quantity flowing into the connecting passage is at the maximum.

13. The exhaust gas recirculation system in the engine system according to claim 8, wherein the opening degree of the first exhaust gas regulating valve is set to the fully opened position when the catalyst temperature is lower than a predetermined value so that the exhaust gas quantity flowing into the connecting passage is at a minimum, and the opening degree of the first exhaust gas regulating valve being set to the fully closed position when the catalyst temperature is equal to or more than the predetermined value so that the exhaust gas quantity flowing into the connecting passage is at the maximum.

14. The exhaust gas recirculation system in the engine system according to claim 1, wherein an opening degree of the exhaust gas regulating valve is varied between a fully opened position, a fully closed position and an intermediate position in response to at least one of a temperature of the engine coolant, an engine speed, an engine load and a temperature of a catalyst, or in response to any combination of the temperature of the engine coolant, the engine speed, the engine load, and the temperature of a catalyst to control the exhaust gas quantity flowing into the connecting passage.

15. The exhaust gas recirculation system in the engine system according to claim 2, wherein an opening degree of the first exhaust gas regulating valve is varied between a fully opened position, a fully closed position and an intermediate position in response to at least one of a temperature of the engine coolant, an engine speed, an engine load, and a temperature of a catalyst, or in response to any combination of the temperature of the engine coolant, the engine speed, the engine load, and the temperature of a catalyst to control the exhaust gas quantity flowing into the connecting passage.

16. The exhaust gas recirculation system in the engine system according to claim 5, wherein the opening degree of the exhaust gas regulating valve is varied between the fully closed position, the intermediate position and the fully opened position independently of a temperature of the engine coolant in response to the increase of the engine speed and the engine load to decrease the exhaust gas quantity flowing into the connecting passage.

17. The exhaust gas recirculation system in the engine system according to claim 6, wherein the opening degree of the first exhaust gas regulating valve is varied between the fully closed position, the intermediate position and the fully opened position independently of a temperature of the engine coolant in response to the increase of the engine speed and the engine load to decrease the exhaust gas quantity flowing into the connecting passage.

18. The exhaust gas recirculation system In the engine system according to claim 7, wherein the opening degree of the exhaust gas regulating valve is varied from the fully opened position, the intermediate position, and the fully closed position independently of a temperature of the engine coolant in response to the increase of the catalyst temperature to increase the exhaust gas quantity flowing into the connecting passage.

19. The exhaust gas recirculation system in the engine system according to claim 8, wherein the opening degree of the first exhaust gas regulating valve is varied between the fully opened position, the intermediate position, and the fully closed position independently of a temperature of the engine coolant in response to the increase of the catalyst temperature to increase the exhaust gas quantity flowing into the connecting passage.

20. An exhaust gas recirculation system in an engine system, comprising:

an exhaust passage extending from an exhaust manifold of an engine;

a muffler disposed along the exhaust passage;

an EGR passage communicating with the exhaust passage at a point upstream of the muffler to direct the exhaust gas from the exhaust passage towards a heat exchanger mounted in the EGR passage;

a connecting passage fluidly connected to the EGR passage at a point downstream from the heat exchanger and fluidly connected to the exhaust passage at a point downstream from where the EGR passage communicates with the exhaust passage; and an exhaust gas regulating valve mounted between the muffler and the point at which the EGR passage communicates with the exhaust passage to control both a quantity of exhaust gas in the EGR passage which is directed back to the exhaust passage through the connecting passage and a quantity of exhaust gas in the exhaust passage upstream of the exhaust gas regulating valve which passes directly to the muffler without being directed to the EGR passage.

* * * * *